United States Patent [19]

Kmelisch

[11] 3,981,171

[45] Sept. 21, 1976

[54] TWIN DRIVE FOR ROLLING MILLS

[75] Inventor: Wolfgang Kmelisch, Berlin, Germany

[73] Assignee: Siemens Aktiengesellschaft, Munich, Germany

[22] Filed: Nov. 7, 1975

[21] Appl. No.: 629,912

[30] Foreign Application Priority Data

Nov. 12, 1974 Germany ..... 2454036

[52] U.S. Cl. ..... 72/249

[51] Int. Cl.[2] ..... F16P 7/00

[58] Field of Search ..... 72/249; 74/612

[56] References Cited

UNITED STATES PATENTS

| | | | |
|---|---|---|---|
| 150,516 | 5/1874 | Briggs et al. | 72/249 |
| 3,831,410 | 8/1974 | Properzi | 72/5 |

*Primary Examiner*—Milton S. Mehr

*Attorney, Agent, or Firm*—Kenyon & Kenyon Reilly Carr & Chapin

[57] ABSTRACT

The invention is directed to an improvement for a twin drive rolling mill wherein upper and lower rollers are connected with the rotor shafts of corresponding drive motors through respective transmission chains. An elevated bearing support platform is provided over which the upper-roller transmission chain is guided. Each transmission chain includes a coupling that permits longitudinal displacements, a spindle, and an axial pressure bearing. The upper-roller transmission chain further includes an intermediate shaft, a radial bearing mounted on the support platform for accommodating the intermediate shaft, and a support-beam structure arranged laterally of the spindle for supporting the spindle. The improvement includes a lever pivotally mounted on the elevated bearing support platform and a connection bolt for connecting the support-beam structure to the lever. The bolt is constructed to rupture upon the application of a predetermined force between the lever and the support platform to thereby prevent excessive forces from being transmitted to the latter.

5 Claims, 3 Drawing Figures

Fig. 1
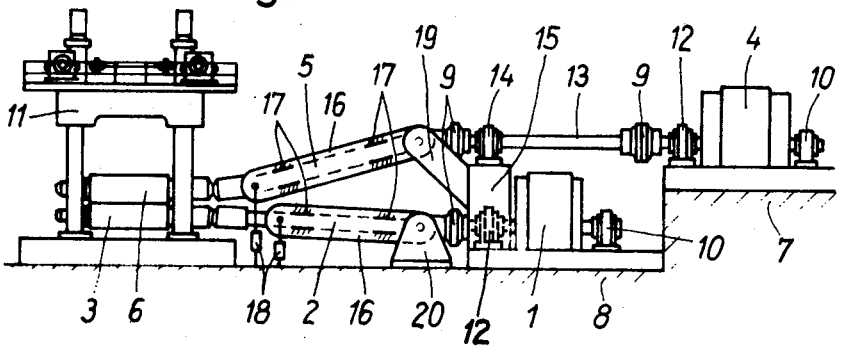
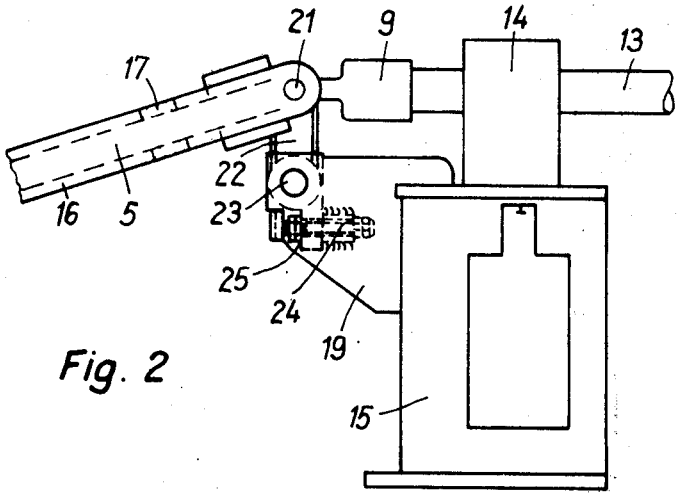
Fig. 2
Fig. 3
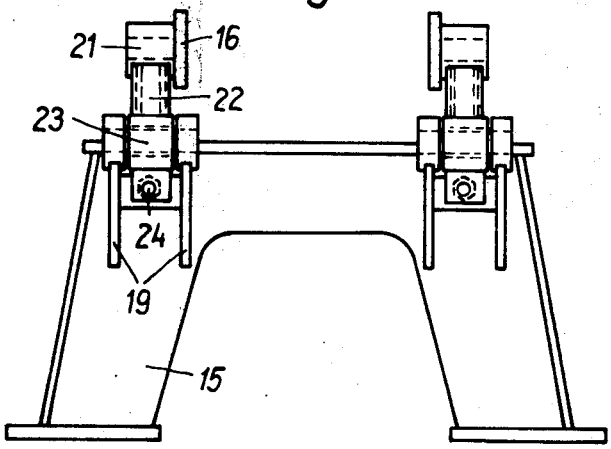

TWIN DRIVE FOR ROLLING MILLS

BACKGROUND OF THE INVENTION

In twin drives for rolling mills, the upper and the lower rollers are driven by separate electric motors, one of which is arranged at an elevated location. Each of the rollers is connected with a roller stand. Each of the rollers is also connected with the rotor shaft of the drive motor via couplings which permit longitudinal displacement besides angular motion, and via spindles. The rotor shaft of the lower motor is connected directly with the spindles, and that of the upper motor via an intermediate shaft. Next to the couplings, respective radial bearings are arranged, of which the radial bearing of the intermediate shaft is mounted on an elevated bearing support platform. In addition, a thrust bearing is provided in each shaft chain which in general is disposed at the end of the motor shaft.

It is furthermore customary to support the spindles in laterally arranged support beams in order to obtain a balanced arrangement of the spindles. The support beams, in turn, are supported hydraulically on one side, while they have a separate bearing on the other side, which is attached at the elevated bearing support platform in the case of the upper support beam, while the lower support beam is supported directly on the foundation or also at the bearing support platform. Thereby, the axial forces occurring in the roller stand are transmitted through the spindles and support beams to the elevated bearing support platform.

In such a twin drive, very large fast decaying axial forces can occur in the event of a break of a roller depending on the inclination of the break. These forces are not transmitted via the lateral support beams to the elevated bearing support platform because the couplings provided in the shaft chain permit longitudinal displacements. However, there is the danger that because of the rather high attachment point of the lateral support beams at the elevated bearing support platform, the strength of the latter is exceeded so that damage to the bearing support platform occurs. Accordingly, it is an object of the invention to limit the axial forces acting in a twin drive of the above described type on the elevated bearing support platform to a permissible value.

SUMMARY OF THE INVENTION

The above object is achieved with the improvement according to the invention which is suitable for a twin drive for rolling mills wherein the upper and lower rollers are connected with the rotor shafts of the drive motors through respective transmission chains. Each transmission chain includes a coupling which permits longitudinal displacement, a spindle, and a thrust bearing. An elevated bearing support platform over which the upper-roller transmission chain is guided is also provided. The upper-roller transmission chain further includes an intermediate shaft and a radial bearing mounted on the support plaform for accommodating the intermediate shaft. The spindle of the upper-roller transmission chain is connected via laterally arranged a support-beam structure with the elevated bearing support platform. According to the improvement of the invention, the lateral support-beam structures are connected with a lever which is rotatably supported at the elevated bearing support platform and which, in turn, is fastened at the elevated bearing support platform via a bolt with a predetermined break point.

Thus, a predetermined break point is inserted into the connection between the lateral support-beam structure and the elevated bearing support platform. However, as this break point is not located directly at the end of the support-beam structure, but rather, the support-beam structure is first connected with a fulcrumed lever which only then acts on the predetermined break point, the further advantage is obtained that the construction of the bolt serving as the predetermined break point can be influenced by varying the lever arm. The lever and the bolt determine the maximum axial force which is transmitted directly from the lateral support-beam structure to the elevated bearing support platform.

Now, if large axial forces occur briefly in the twin drive, for instance, due to a roller fracture, these are first transmitted in the transmission chain directly to the elevated bearing support platform via the lateral support-beam structure, the lever, and the bolt because of the longitudinal displacement made possible by the couplings. Upon further increase of the forces, the bolt is sheared through after the set permissible maximum axial force is reached, which can safely be taken up by the elevated bearing support platform, so that the connection between the lateral support-beam structure and the elevated bearing support platform is interrupted. Even so, the guidance of the lateral support-beam structure is preserved through the articulated support of the lever. With the bolt sheared off, the remaining axial thrust is transmitted directly via the transmission chain to the thrust bearing provided in the transmission which takes up these forces. In this manner, it is achieved that the elevated bearing support platform is kept free of axial forces which would exceed its mechanical strength.

Also in the case that the lower support-beam structure is supported in a separate bearing support on the foundation, it is advisable to make the connection also there with the aid of a fulcrumed lever, which on its part is fastened to the separate bearing support via a bolt with a predetermined break point. Thereby, the load on the bearing support is reduced and damage to the separate bearing support or the foundation is avoided.

Although the invention is illustrated and described herein as a twin drive for rolling mills, it is nevertheless not intended to be limited to the details shown, since various modifications may be made therein within the scope and the range of the claims. The invention, however, together with additional objects and advantages will be best understood from the following description and in connection with the accompanying drawings.

BRIEF DESCRIPTION OF THE DRAWINGS

FIG. 1 is a schematic diagram of a twin drive rolling mill equipped with an improvement according to the invention.

FIGS. 2 and 3 show, on a considerably enlarged scale, the attachment of the lateral support beam supporting the upper spindle at the elevated bearing support platform.

DESCRIPTION OF THE PREFERRED EMBODIMENTS OF THE INVENTION

A twin drive for rolling mills includes the electric motor 1 which drives the lower roll 3 through the spindle 2, and of the upper electric motor 4 which drives the upper roll 6 through the spindle 5. The upper electric motor 4 stands on an elevated part 7 of the foundation 8 while the lower motor 1 is simply arranged on the foundation 8.

The spindles 2 and 5 are connected with the motor shaft by means of respective couplings 9. Each of the couplings 9 permits longitudinal displacements in the shaft chain in addition to angular motion. On the side facing away from the spindles 2, 5, the motor shaft is supported in a thrust bearing 10, which is combined with a radial bearing. The upper roll 6 and the lower roll 3 are connected by the roll stand 11. In each shaft chain, there is further arranged a radial bearing 12. The radial bearings 12 are located ahead of the electric motors 1 and 4, respectively.

Because the upper electric motor 4 is arranged behind the lower motor 1, the intermediate shaft 13 is arranged in a shaft chain of motor 4 between the spindle 5 and the motor shaft. Couplings 9 are arranged at both ends of the intermediate shaft 13. On the side facing away from the motor 4, the intermediate shaft 13 is further especially supported in a radial bearing 14, which stands on an elevated bearing support platform 15.

The spindles 2, 5 are supported by means of laterally arranged support-beam structures 16 in which the spindles 2, 5 are each supported in two bearing locations 17. On the one end, the support-beam structures 16 are connected with hydraulic supports 18, while on the other end they are supported in bearing supports 19 and 20. Of these, the upper bearing support 19 is attached to the elevated bearing support platform 15 for the radial bearing 14 of the intermediate shaft 13, while the lower bearing support 20 stands on the foundation 8. The axial forces occurring at the roll stand 11 can be transmitted by the support-beam structure 16 via the spindle 5 to the elevated bearing support platform 15.

Such axial forces can occur if a roll breaks off at an angle and can assume very large values for a short time. These axial forces are transmitted through a rather high point of application to the elevated bearing support platform 15. So that these axial forces cannot assume excessive values which might lead to damage to the elevated bearing support platform 15, the attachment of the support-beam structures 16 by means of the bearing support 19 at the elevated bearing support platform 15 is made according to the invention in the manner shown in FIGS. 2 and 3.

The end of the lateral support-beam structure 16 is attached by means of connection means in the form of a pivot connection 21 to a lever 22, which in turn is supported in the bearing support 19 by the bearing joint 23. So that now axial forces can be transmitted via this lever 22, the lever 22 is attached to the elevated bearing support platform 15 via the bearing support 19 by means of rupture means in the form of a bolt 24. This bolt 24 contains a predetermined break point 25, which is sheared off if a certain axial force, which is predetermined by the lever arm and the bolt dimensions, is exceeded. By constructing the attachment of the support-beam structure 16 in the form of a pivotal joint 21, the advantage is obtained that the bolt 24 with the predetermined break point 25 is not stressed flexurally, but only in tension. In addition, after the bolt 24 is sheared off, the guidance of the support-beam structure 16 is preserved.

Also in the case of the bearing support 20, which stands directly on the foundation 8, the attachment of the support-beam structure 16 can be made as described with the aid of a fulcrumed lever and second rupture means in the form of a bolt with a predetermined break point, which in turn is attached to the bearing support 20. Then, the axial force to be transmitted to the bearing support 20 is also limited and damage to the bearing support 20 or the foundation 8 is avoided.

Therefore, axial forces are at most transmitted to the bearing support platform 15, which are smaller than this permissible limit. After the bolt 24 is sheared off, the connection between the support-beam structure 16 and the bearing support platform 15 is interrupted and larger axial forces that might occur, must be transmitted directly through the shaft chain to the thrust bearing 10 and be taken up by the latter.

What is claimed is:

1. In a twin drive rolling mill having upper and lower rollers connected with the rotor shafts of corresponding drive motors through respective transmission chains, an elevated bearing support platform over which the upper-roller transmission chain is guided, each transmission chain including: a coupling that permits longitudinal displacements, a spindle, and an axial pressure bearing for the taking up forces transmitted along the transmission chain; the upper-roller transmission chain further including: an intermediate shaft, a radial bearing mounted on the support platform for accommodating the intermediate shaft, and a support-beam structure arranged laterally of the spindle for supporting the spindle, the improvement comprising: a lever pivotally mounted on the elevated bearing support platform; connection means for connecting said support-beam structure to said lever; and, rupture means connecting said lever to the support platform for rupturing upon the application of a predetermined force between said lever and the support plaform.

2. The improvement of claim 1, said connection means being a pivot connection.

3. The improvement of claim 2 wherein the improvement further comprises: a bearing support mounted on the support platform; said rupture means being a bolt having a rupture location whereat the same ruptures when said predetermined force is exceeded, said bolt being connected between said lever and said bearing support.

4. In a twin drive rolling mill mounted on a foundation and having upper and lower rollers connected with the rotor shafts of corresponding drive motors through respective transmission chains, an elevated bearing support platform over which the upper-roller transmission chain is guided, each transmission chain including: a coupling that permits longitudinal displacements, a spindle, and an axial pressure bearing for taking up forces transmitted along the transmission chain; the upper-roller transmission chain further including: an intermediate shaft, a radial bearing mounted on the support platform for accommodating the intermediate shaft, and a support-beam structure arranged laterally of the spindle for supporting the spindle; the lower-roller transmission chain further including a support-beam structure arranged laterally of the spindle of the lower-roller transmission chain for supporting the same, the rolling mill further including a bearing support arranged on the foundation, the improvement comprising: a lever pivotally mounted on the elevated bearing support platform; connection means for connecting said support-beam structure to said lever; rupture means connecting said lever to the support platform for rupturing upon the application of a predetermined force between said lever and the support platform; a second lever pivotally mounted on said bearing support, second connection means for connecting the support-beam structure of the lower-roller transmission chain to said second lever; and, second rupture means connecting said second lever to the bearing support for rupturing upon the application of a predetermined force between said second lever and the bearing support.

5. The improvement of claim 4, said first-mentioned connection means being a pivot connection; and said second connection means likewise being a pivot connection.

* * * * *